US007758925B2

(12) United States Patent
Seth

(10) Patent No.: US 7,758,925 B2
(45) Date of Patent: Jul. 20, 2010

(54) CRACK-FREE EROSION RESISTANT COATINGS ON STEELS

(75) Inventor: Brij B. Seth, Maitland, FL (US)

(73) Assignee: Siemens Energy, Inc., Orlando, FL (US)

( * ) Notice: Subject to any disclaimer, the term of this patent is extended or adjusted under 35 U.S.C. 154(b) by 327 days.

(21) Appl. No.: 11/858,979

(22) Filed: Sep. 21, 2007

(65) Prior Publication Data

US 2009/0081478 A1 Mar. 26, 2009

(51) Int. Cl.
*B05D 3/00* (2006.01)

(52) U.S. Cl. ..... 427/398.1; 427/128; 427/383.1; 427/436; 148/522; 148/525; 148/529; 148/537; 148/561; 428/678; 428/679; 428/685; 428/652; 428/653; 428/938

(58) Field of Classification Search ..... 427/398.1; 148/522; 428/678
See application file for complete search history.

(56) References Cited

U.S. PATENT DOCUMENTS

| | | | | |
|---|---|---|---|---|
| 3,972,751 | A | 8/1976 | Engelhard | |
| 4,318,944 | A | 3/1982 | Hall | |
| 4,761,346 | A | 8/1988 | Naik | |
| 5,017,410 | A | 5/1991 | Hodgens, II | |
| 5,190,598 | A | 3/1993 | Qureshi | |
| 5,236,788 | A | 8/1993 | Manier et al. | |
| 5,275,844 | A | 1/1994 | Moore | |
| 5,981,081 | A | 11/1999 | Sue | |
| 6,022,625 | A | 2/2000 | Bremmer et al. | |
| 6,099,666 | A | 8/2000 | Powell | |
| 6,296,909 | B1 | 10/2001 | Spitsberg et al. | |
| 6,475,647 | B1 * | 11/2002 | Mendez Acevedo et al. | 428/678 |
| 6,632,301 | B2 * | 10/2003 | Krauss et al. | 148/579 |
| 6,835,465 | B2 | 12/2004 | Allen et al. | |
| 7,067,022 | B2 * | 6/2006 | Branagan | 148/525 |
| 2007/0102068 | A1 | 5/2007 | Taniguchi et al. | |

FOREIGN PATENT DOCUMENTS

| | | | |
|---|---|---|---|
| EP | 0438268 | A1 | 7/1991 |
| JP | 52062121 | A | 5/1977 |
| WO | 2004104245 | A2 | 12/2004 |

OTHER PUBLICATIONS

Y.C. Liu, Journal of Materials Science, vol. 39, (2004), pp. 4009-4011.*

* cited by examiner

*Primary Examiner*—Nadine Norton
*Assistant Examiner*—Maki Angadi

(57) ABSTRACT

A method for preparing a protective layer (38) on a surface of the substrate (36) that requires a bonding temperature (BT) above a detrimental phase transformation temperature range (28) of the substrate, and then cooling the layer and substrate without cracking the layer or detrimentally transforming the substrate. The protective layer (38) and the substrate (36) are cooled from the bonding temperature (BT) to a temperature (46) above the detrimental phase transformation range (28) at a first cooling rate (30) slow enough to avoid cracking the protective layer. Next, the protective layer and the substrate are cooled to a temperature below the detrimental phase transformation range of the substrate at a second cooling rate (27) fast enough to pass the detrimental phase transformation range before a substantial transformation of the substrate into the detrimental phase can occur.

9 Claims, 4 Drawing Sheets

FIG 1 Prior Art Continuous Cooling Transformation (CCT) Diagram

FIG 3 Continuous cooling with rate change
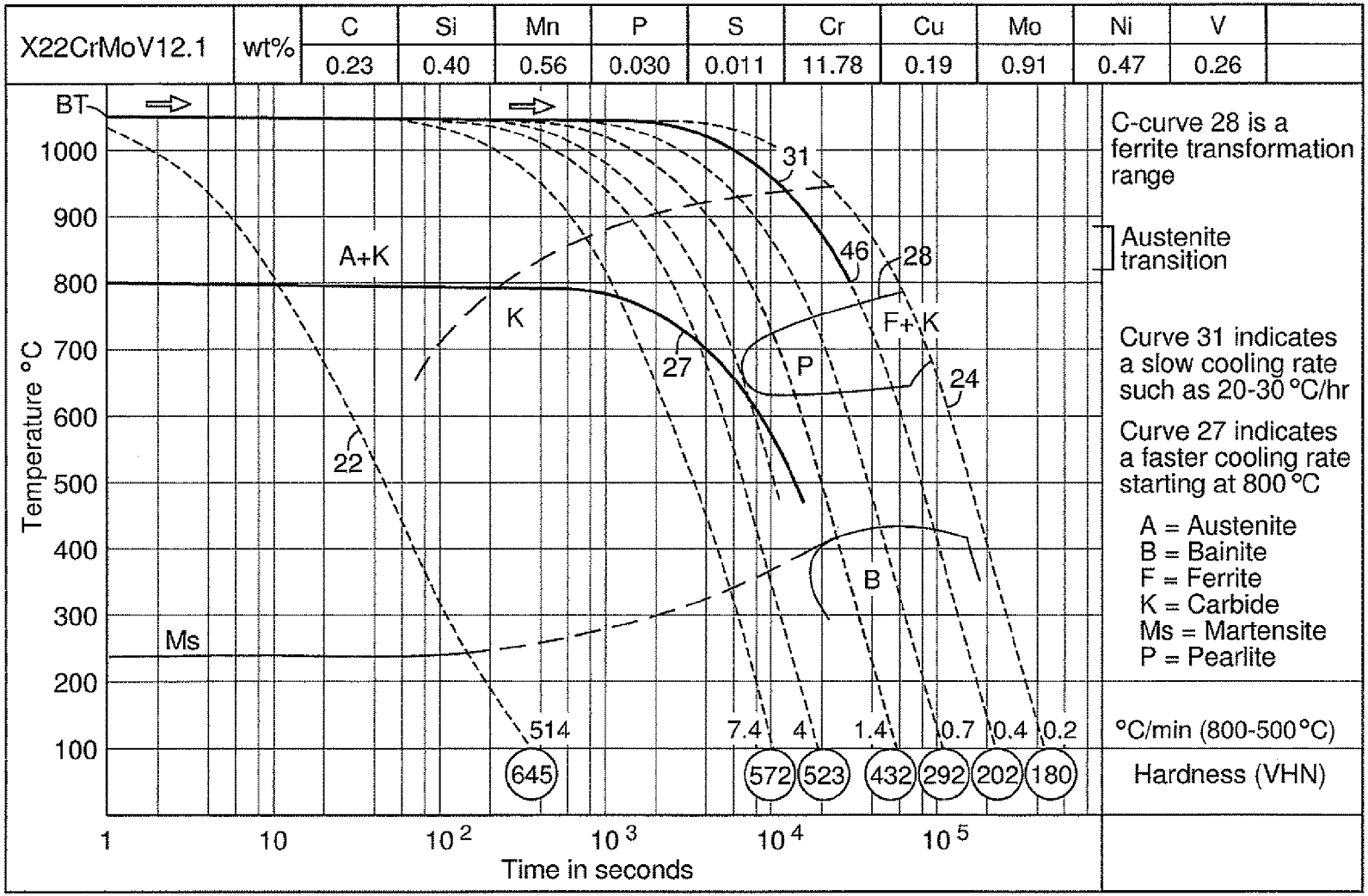

FIG 4 Stepped cooling (linear diagram)
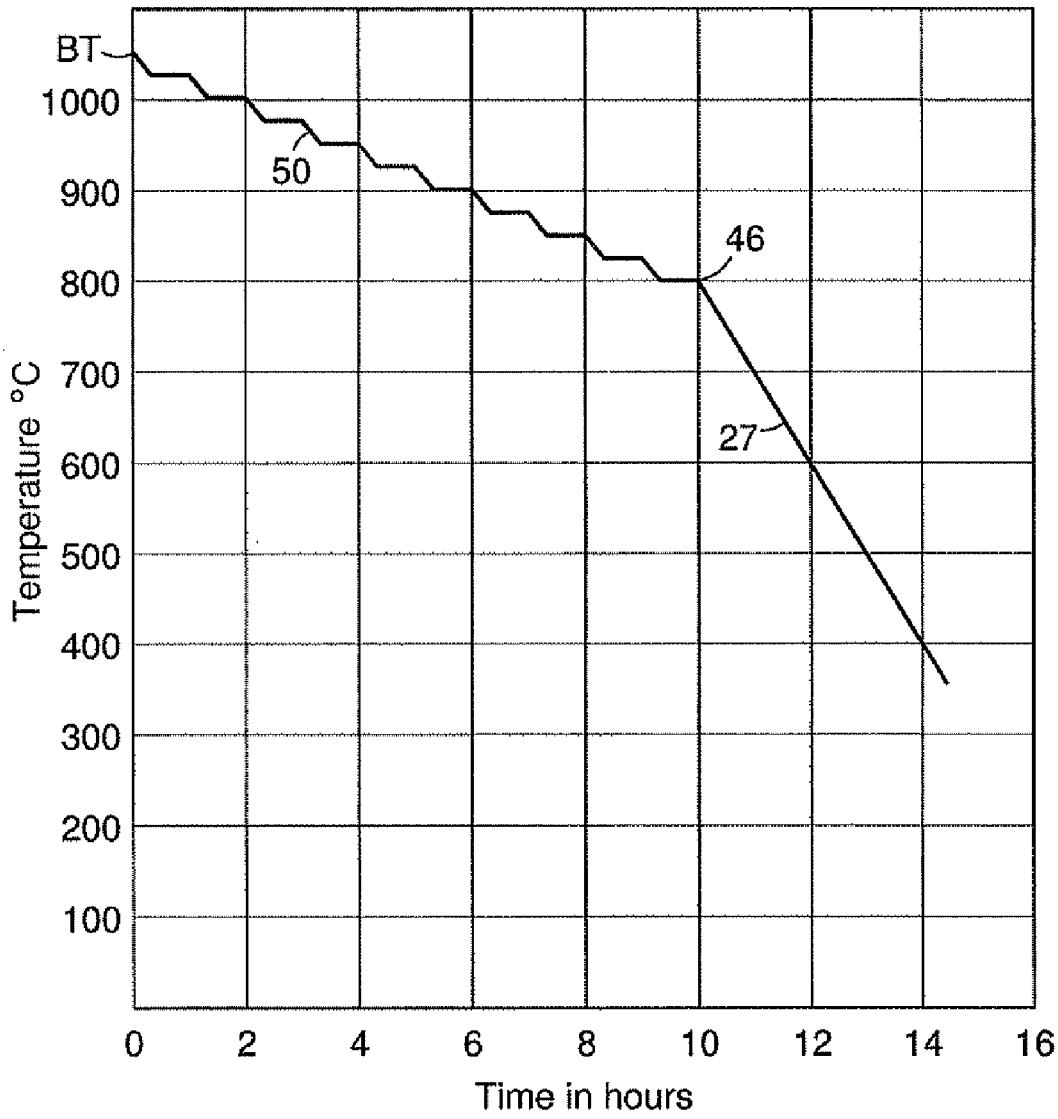

CRACK-FREE EROSION RESISTANT COATINGS ON STEELS

FIELD OF THE INVENTION

This invention relates to protective coatings for components in high-temperature environments, and particularly for boride and carbide coatings on steel components in steam turbines.

BACKGROUND OF THE INVENTION

Solid particle erosion of high-temperature components is a major issue in steam turbine engines. Nozzle blocks, control stage blades and intermediate pressure blades are particularly susceptible to solid particle erosion. Erosion changes the airfoil geometry and results in a loss of turbine efficiency. Erosion also creates sharp notches which may, under certain vibratory loads, lead to fatigue failures. Studies have been conducted to understand the mechanism of erosion and to find ways of minimizing it. These include bypassing steam during start-up, altering the airfoil profiles and using erosion resistant coatings.

The most commonly used types of erosion coatings are boride and carbide. Boride coatings may be applied by diffusion. A component is embedded in a boron-containing material, held at an elevated temperature for sufficient time, cooled continuously to room temperature, and finally tempered at a temperature and time appropriate to the substrate alloy. Extensive research conducted on the subject suggests that it is virtually impossible to produce crack-free boride coatings for parts. Coating cracks significantly reduce the fatigue strength of the coated parts.

FIG. 1 is a continuous cooling transformation (CCT) diagram. Unlike isothermal transformation curves, which depend only upon fixed temperatures, CCT diagrams are concerned with both transformation time and temperature under certain cooling rates. Accordingly, CCT diagrams are useful for commercial heat treatments and in welding industries. In the prior art example of FIG. 1, the curves starting at a bonding temperature BT (i.e. a boriding or carbiding temperature), and sloping downward to the right, are sample cooling rates. The fastest cooling rate is shown by curve 22, and the slowest rate is shown by curve 24. Metallographic phases at various temperature ranges and cooling rates are marked on the diagram, and are identified in the legend. Curve 28 is a ferrite transformation range or C-curve, within which a substantial amount of ferrite transformation will occur, depending on the cooling rate. A slow-cooling curve 30 passes through the ferrite transformation range 28. A faster-cooling rate 26 passes the ferrite transformation curve 28 before any or any substantial amount of ferrite transformation can occur.

Many high-temperature steam turbine blades are made of 12% Cr type steels such as AISI 403, 422 and others. These alloys attain strength through martensitic transformation achieved by rapid cooling from the austenitizing temperature. The slowest cooling rate cannot be less than that required to avoid passing through the ferrite transformation curve. For example, X22CrMoV12.1 steel should be cooled from 1050 to 650 degrees C. in less than two hours, requiring a cooling rate greater than 200 degrees C. per hour. However, this minimum cooling rate required to attain strength is not slow enough to prevent the boride coating from developing cracks as illustrated in FIG. 2. Similarly, minimum cooling rate required to attain strength in AISI 422 is 400 degrees C. per hour.

BRIEF DESCRIPTION OF THE DRAWINGS

The invention is explained in the following description in view of the drawings that show:

FIG. 3 illustrates two-stage cooling with a first slow cooling rate that avoids cracking the coating, followed by second faster cooling rate that misses the ferrite transformation curve.

FIG. 4 shows an example of stepped slow cooling followed by faster cooling.

DETAILED DESCRIPTION OF THE INVENTION

Figure 1:
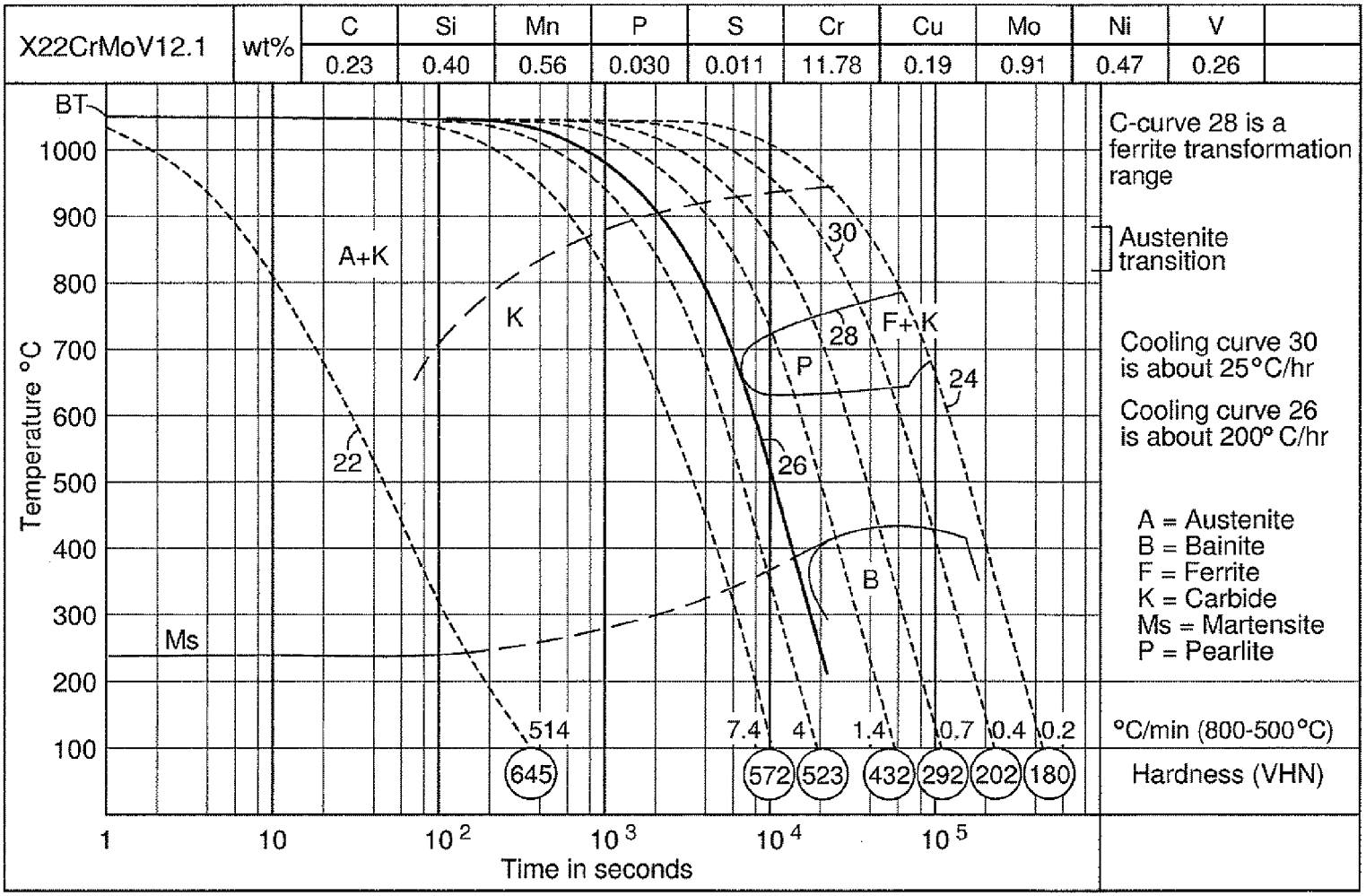
FIG. 1 is a prior art continuous cooling transformation diagram for a steel alloy.
Figure 2:
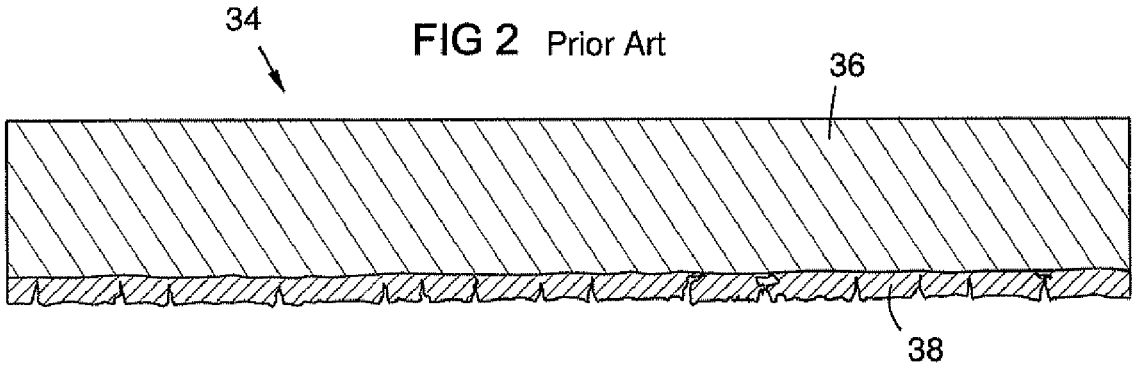
FIG 2 Prior Art
FIG. 2 illustrates a prior art section of a coated substrate with a cracked coating.

Cracks develop in a boride coating during the cooling cycle after bonding of the coating to the substrate, due to a thermal expansion mismatch between a coating such as FeB or $Fe_2B$ and a steel substrate. FIG. 2 illustrates a coated substrate system 34 with a substrate 36 and a protective layer 38 that has cracked by cooling the coating 38 too fast. One way to eliminate cracking is to cool the parts very slowly. Unfortunately, as explained above, cooling below a certain critical rate prevents the steel from hardening to its full strength. The challenge of producing acceptable strength and crack-free boride or carbide coatings is met by the present invention using two or more cooling rates.

As shown in FIG. 3, a coated steel component may be cooled from a bonding temperature BT to a temperature near but above the ferrite transformation curve 28, such as to 800 degrees C., at a rate 31 slow enough to prevent cracking of the coating. No ferrite transformation occurs above the ferrite curve 28, making it possible to use the desired slow cooling rate 31. Since no ferrite incubation time has been consumed, the part has effectively been cooled to the selected temperature 46 near the upper portion of the ferrite transformation curve in "zero" time with no change occurring in the structure of the substrate. Next, the component may be cooled from the temperature 46 above the ferrite curve 28 to a temperature below the ferrite curve at a rate 27 fast enough to prevent substantial ferrite transformation in the substrate, but slow enough to prevent cracking the coating, which has now stabilized. For example, first cool a substrate of X22CrMoV12.1 steel from 1050 to 800 degrees C. slowly enough to prevent boride cracking, for example at less than 40 degrees C. per hour, or preferably 20-30 degrees C. per hour. Then, from 800 to 650 degrees C., cool it at a second rate that is fast enough to miss the ferrite transformation curve, such as faster than 100 degrees C. per hour. The minimum second cooling rate will depend on the substrate composition and the component structural requirements.

To demonstrate the validity of this approach, a sample of St 422 was heated to 970 C, held for three hours to simulate the coating bonding cycle. It was then cooled to 760 C at 28 degrees C. per hour, and then cooled at 110 C per hour down to 540 C. No ferrite transformation was seen. The quenched hardness of the sample indicated full martensite transformation.

FIG. 4 illustrates an embodiment of the invention that prevents cracking and uses a stepped cooling rate 50 from the bonding temperature BT to a temperature 46 that is selected to be near the upper limit of the C curve (not shown on this linear diagram). Pausing periodically generally isothermally in steps 50 relieves strain created by each change in temperature, thus eliminating the accumulation of strain. For example, steps of about 25 degrees C. followed by respective isothermal hold periods of an hour may be used. Each step may be limited to a slow cooling rate as described above, such as less than 40 degrees C. per hour, or each step may use a faster rate, compensated by the hold periods to achieve average cooling rates of less than 40 C per hour, or preferably 20-30 C per hour. Then a faster cooling rate 27 is used to miss the ferrite transformation region of the C curve. The multiple cooling rates discussed herein may be achieved using techniques known in the art using known programmable temperature controllers.

In another embodiment a boride or carbide coating may be applied/formed at a first bonding temperature and cooled sufficiently slowly at a first cooling rate to avoid cracking without concern for ferrite formation in the substrate material. Thereafter, the coated substrate can be reheated to a second temperature above the austenitizing temperature and above the ferrite transformation temperature range in order to heat treat the substrate, and then cooled as described above with at least second and third cooling rates in order to avoid or minimize the formation of ferrite during the cooling process.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A method for bonding and cooling a protective coating on a substrate, comprising:

preparing a protective layer on a surface of a substrate at a first temperature, wherein the first temperature is above a given detrimental phase transformation temperature range of the substrate;

cooling the protective layer and the substrate at a first cooling rate from the first temperature to a temperature that is still above the given detrimental phase transformation temperature range of the substrate, wherein the first cooling rate is slow enough to avoid cracking the protective layer; and next cooling the protective layer and the substrate at a second cooling rate greater than the first cooling rate to a temperature below the given detrimental phase transformation temperature range of the substrate.

2. The method of claim 1, wherein the protective layer comprises a boride or a carbide material, the substrate comprises a steel alloy, and the detrimental phase transformation comprises a ferrite transformation.

3. The method of claim 2, wherein the first cooling rate is less than 40 degrees C. per hour, and the second cooling rate is above 100 degrees C. per hour.

4. The method of claim 3, wherein the first cooling rate is in the range of 20-30 degrees C. per hour.

5. The method of claim 3, wherein the protective layer comprises at least one of the group of FeB and $Fe_2B$.

6. The method of claim 2, wherein the first cooling rate comprises a stepped cooling function comprising a plurality of steps of cooling, each step followed by a generally isothermal hold period sufficient to relieve strain in the protective layer caused by the immediately preceding step change in temperature, wherein the first cooling rate averages less than 40 degrees C. per hour, and the second cooling rate is above 100 degrees C. per hour.

7. The method of claim 6, wherein the stepped cooling function comprises cooling steps of approximately 25 degrees C., followed by respective hold times of approximately 1 hour.

8. The method of claim 6, wherein each cooling step of the first cooling rate is performed at a cooling rate of less than 40 degrees C. per hour, not counting the hold period.

9. A method for bonding and cooling a protective coating on a substrate, comprising:

preparing a boride or carbide coating on a surface of a steel alloy at a first temperature above a ferrite transformation temperature range of the steel alloy;

cooling the coated alloy at a first cooling rate sufficiently slow to avoid cracking of the coating without concern for ferrite formation in the steel alloy;

reheating the coated alloy to a second temperature above an austenitizing temperature and above the ferrite transformation temperature range of the steel alloy in order to heat treat the steel alloy;

then cooling the coated alloy at a second cooling rate from the second temperature to a third temperature that is still above the ferrite transformation temperature range of the steel alloy; and next cooling the coated alloy at a third cooling rate greater than the second cooling rate to a temperature below the ferrite transformation temperature range of the steel alloy.

* * * * *